US006464934B2

(12) United States Patent
Schrey et al.

(10) Patent No.: US 6,464,934 B2
(45) Date of Patent: Oct. 15, 2002

(54) METHOD FOR MANUFACTURING A RARE EARTH ELEMENT—IRON—BORON PERMANENT MAGNET

(75) Inventors: Peter Schrey, Seeheim-Jugenheim; Mircea Velicescu, Waldshut, both of (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/771,806

(22) Filed: Jan. 29, 2001

(65) Prior Publication Data

US 2001/0006605 A1 Jul. 5, 2001

Related U.S. Application Data

(63) Continuation-in-part of application No. 09/254,409, filed as application No. PCT/DE97/01787 on Aug. 19, 1997, now abandoned.

(30) Foreign Application Priority Data

Sep. 6, 1996 (DE) ..... 196 36 283

(51) Int. Cl.[7] ..... B22C 3/12

(52) U.S. Cl. ..... 419/38; 419/57; 419/60

(58) Field of Search ..... 419/38, 57, 60

(56) References Cited

U.S. PATENT DOCUMENTS 6,027,576 A * 2/2000 Schrey et al. ..... 148/100
6,254,659 B1 * 7/2001 Schrey et al. ..... 75/244

* cited by examiner

*Primary Examiner*—Daniel J. Jenkins
(74) *Attorney, Agent, or Firm*—Schiff Hardin & Waite

(57) ABSTRACT

In a method for manufacturing a permanent magnet, a powder of a magnetic base alloy and powders of at least two binder alloys are mixed. The magnetic base alloy has a general formula $SE_2T_{14}B$, wherein SE is at least one rare earth element, including Y, and T is Fe or a combination of Fe and Co, wherein Co does not exceed 40 wt % of the combination of Fe and Co. The two binder alloys have respective general formulas $SE_6(Fe,Co)_{13-x}Ga_{1+x}$ and $SE_2Co_3$. The base alloy and the at least two binder alloys are mixed in a weight ratio between 99:1 and 89:11. The mixture is then compressed and is subsequently sintered in a vacuum and/or in an inert gas atmosphere.

2 Claims, 1 Drawing Sheet

METHOD FOR MANUFACTURING A RARE EARTH ELEMENT— IRON— BORON PERMANENT MAGNET

This application is a continuation-in-part of U.S. patent application 09/254,409 filed Mar. 5, 1999, now abandoned which is a 371 of application Ser. No. PCT/OE97/01787, filed Aug. 19, 1997.

BACKGROUND OF THE INVENTION

1. Field of the Invention

The present invention is directed to a permanent magnet of the type SE-Fe—B that has the tetragonal phase $SE_2Fe_{14}B$ as the principal phase, wherein SE is at least one rare earth element, including Y.

2. Description of the Prior Art

A magnet of the above general type is disclosed, for example, in European Application 0 124 655 and in U.S. Pat. No. 5,230,751 that corresponds therewith. Magnets of the type SE-Fe—B exhibit the highest energy densities currently available. SE-Fe—B magnets manufactured by powder metallurgy contain approximately 90% of the hard-magnetic principal phase $SE_2Fe_{14}B$.

German OS 41 35 403 discloses a two-phase magnet, wherein the second phase can be a SE-Fe—Co—Ga phase.

European Application 0 583 041 likewise discloses a two-phase magnet, whereby the second phase is composed of a SE-Ga phase.

U.S. Pat. No. 5,447,578 discloses a SE-transition metal-Ga phase.

One usually proceeds such in the manufacture of such SE-Fe—B magnets by combining a SE-Fe—B base alloy with a composition close to the $SE_2Fe_{14}B$ phase and a binder alloy with a lower melting temperature. The goal is to set the structure of the SE-Fe—B sintered magnets of $SE_2Fe_{14}B$ base alloys with inter-granular binders, while using optimally little binder alloy.

European Application 0 517 179 proposes the employment of binder alloys having the composition $Pr_{20}Dy_{10}Co_{40}B_6Ga_4Fe_{rest}$ (in weight percent, this is Pr≈35, Dy≈20, Co≈28, B≈0.77, Ga≈3.5).

It has now turned out that the proportion of this binder alloy in the mixture of the base alloy must lie within 7–10 weight %. In this mixing range, sinter densities of approximately $\rho>7.55$ g/cm$^3$ are achieved only at sintering temperatures above 1090° C. These sinter densities roughly correspond to 99% of the theoretical density. Outside this mixing range, the sinterability and, thus, the remanence that can be achieved are considerably influenced. The grain growth is highly activated in the magnets with a proportion of this binder alloy of more than 10 weight %, but the pores are not closed. The consequence is the formation of a structure with anomalously large grains (>50 $\mu$m) and with high porosity as well as with low sinter densities. Given lower proportions of binder alloy, the amount of the fluid phase is accordingly not adequate for the densification.

SUMMARY OF THE INVENTION

It is an object of the present invention to provide a powder-metallurgical manufacturing method for permanent magnets of the SE-Fe—B type that exhibits an enhanced sinterability upon reduction of the proportion of binder alloy compared to the known methods and also achieves a very good remanence.

The object is inventively achieved by a method that comprises the following steps:

$a_1$) a powder of a base alloy of the general formula $$SE_2T_{14}B,$$

wherein SE is at least one rare earth element, including Y, and T is Fe or a combination of Fe and Co, whereby the Co part does not exceed 40 weight % of the combination of Fe and Co, $a_2$) and powders of at least two binder alloys of the general formulas $$SE_6(Fe, Co)_{13-x}Ga_{1+x}$$

and $$SE_2CO_3$$

wherein SE is at least one rare earth element, including Y, and wherein $0 \leqq x \leqq 2$, are mixed in a weight ratio of 99:1 to 89:11;

b) the mixture is compressed and, subsequently, c) is sintered in a vacuum and/or in an inert gas atmosphere.

It has been shown that permanent magnets manufactured in this way exhibit very high remanences, and that the proportion of binder alloy compared to the proportion of the base alloy can be reduced to below 7 weight %. Further, the additional gallium-containing phase of the binder alloy exhibits especially good wetting properties.

DESCRIPTION OF THE PREFERRED EMBODIMENTS

Figure 1:
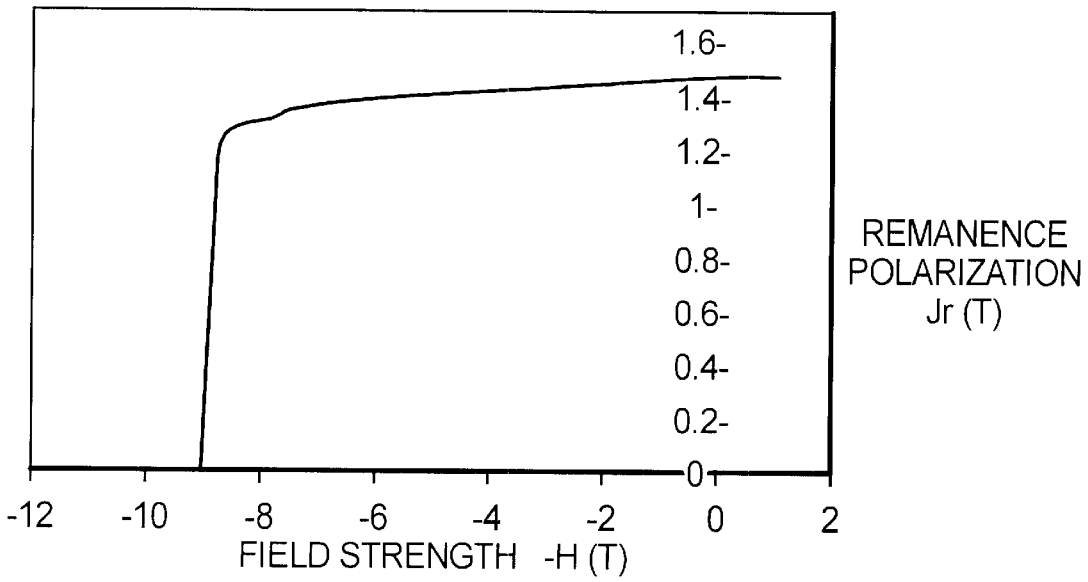
FIG. 1 shows the demagnetization curve exhibited by a magnet made in accordance with the inventive method, at room temperature.

The invention is explained in greater detail below on the basis of the exemplary embodiments and the figures. A $Nd_2Fe_{14}B$ base alloy and five binder alloys with the following compositions were employed for the investigations:

TABLE 1

| Element | B-alloy 1 SV 95/130 | B-alloy 2 SV 95/131 | B-alloy 3 SV 95/132 | B-alloy 4 SV 95/133 | B-alloy 5 SV 95 134 | Base All. SV 96/138 |
|---|---|---|---|---|---|---|
| SE | 50.9 | 47.7 | 64.8 | 51.5 | 50.3 | 28 |
| Nd | 0 | 0 | 0 | 0 | 0 | 28 |
| Pr | 50.9 | 31.7 | 0 | 51.5 | 50.3 | 0 |
| Dy | 0 | 15.7 | 64.8 | 0 | 0 | 0 |

TABLE 1-continued

| Element | B-alloy 1 SV 95/130 | B-alloy 2 SV 95/131 | B-alloy 3 SV 95/132 | B-alloy 4 SV 95/133 | B-alloy 5 SV 95 134 | Base All. SV 96/138 |
|---|---|---|---|---|---|---|
| Co | 23 | 24.65 | 35.2 | 0 | 45.44 | 0 |
| Ga | 4.2 | 4.5 | 0 | 4.25 | 4.15 | 0 |
| B | 0 | 0 | 0 | 0 | 0 | 1.03 |
| Fe | 21.9 | 0 | 0 | 44.25 | 0 | 70.97 |
| Alloy Type | $Pr_6(Fe, Co)_{13}Ga$ | $Pr,Dy_6(Fe, Co)_{13}Ga$ | $Dy_2Co_3$ | $Pr_6Fe_{13}Ga$ | $Pr_6Co_{13}Ga$ | $Nd_2Fe_{14}B$ |

The following mixtures were prepared of coarse powders of these alloys.

TABLE 2

| Part (Wt. %) | B-alloy 1 (Wt. %) | B-alloy 2 (Wt. %) | B-alloy 3 | B-alloy 4 (Wt. %) | B-alloy 5 (Wt. %) | Base All. (Wt. %) |
|---|---|---|---|---|---|---|
| Mixture 1 | 5 | 5 | | | 1 | 89 |
| Mixture 2 | 0 | 5 | 0 | 5 | 0 | 90 |
| Mixture 3 | 5 | 2.5 | 1 | 1.5 | 1 | 89 |
| Mixture 4 | 6 | 0 | 1.5 | 2.5 | 0 | 90 |
| Mixture 5 | 6.5 | 1 | 1.5 | 1 | 1 | 89 |
| Mixture 6 | 5.5 | 0 | 1.5 | 3 | 0 | 90 |
| Mixture 7 | 5 | 1 | 1.5 | 2.5 | 1 | 90 |
| Mixture 8 | 3.5 | 2 | 1 | 3.5 | 0 | 90 |

The calculated composition of the manufactured magnets then yield:

TABLE 3

| Magnet | No. 1 | No. 2 | No. 3 | No. 4 | No. 5 | No. 6 | No. 7 | No. 8 | Ref. |
|---|---|---|---|---|---|---|---|---|---|
| SE | 30.1 | 30.3 | 30.35 | 30.35 | 30.4 | 30.7 | 30.5 | 30.6 | 30–31 |
| Nd | 25.2 | 24.9 | 25.2 | 25.2 | 25.2 | 24.9 | 25.2 | 24.9 | 27–28 |
| Pr | 4.13 | 4.6 | 4.1 | 4.1 | 4.14 | 4.85 | 4.15 | 4.7 | 1.7–2.2 |
| Dy | 0.79 | 0.79 | 1.04 | 1.05 | 1.2 | 0.97 | 1.3 | 0.96 | 0.6–1.4 |
| Co | 2.4 | 1.7 | 2.1 | 2.1 | 2.25 | 2.25 | 1.9 | 2.1 | 0.8–2 |
| Ga | 0.435 | 0.48 | 0.38 | 0.38 | 0.36 | 0.4 | 0.36 | 0.43 | 0.1–0.4 |
| B | 0.93 | 0.92 | 0.93 | 0.92 | 0.93 | 0.92 | 0.92 | 0.92 | 0.95–0.98 |
| Fe | Bal. | Bal. | Bal. | Bal. | Bal. | Bal. | Bal. | Bal. | Bal. |

The mixtures were finely ground in a planetary ball mill for 90 minutes; the average particle size of the fine powder achieved 2.9 to 3.0 $\mu$m. Anisotropic, isostatically pressed magnets were manufactured from the fine powders. They were sintered to densities of $\rho > 7.50$ g/cm$^3$ and subsequently tempered.

FIG. 1 shows the demagnetization curve of the magnets 1–8 at room temperature.

For comparison, a magnet according to the prior art of a binder alloy with the composition of approximately 28 weight % Nd, 0.5 weight % Dy, 2.0 weight % Pr (sum SE≈30.5 weight %), 0.98 weight % B, 0.03 weight % Co and balance Fe was manufactured with the analogous powder-metallurgical method. The same base alloy as in the magnets 8–1 was employed as the base alloy.

Figure 2:
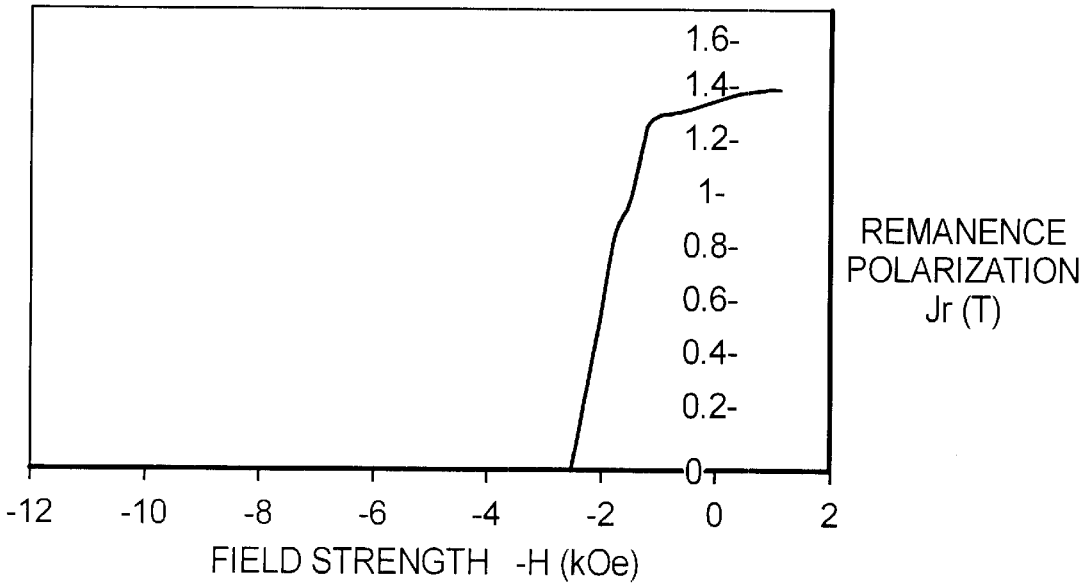
FIG. 2 (PRIOR ART)
FIG. 2 shows the demagnetization curve of a magnet manufactured according to the conventional powder-metallurgical method.

FIG. 2 shows the demagnetization curve of this magnet that has been manufactured according to the conventional powder-metallurgical method according to the prior art.

It can be clearly seen that the inventive permanent magnets exhibit a significantly more favorable demagnetization curve at room temperature than permanent magnets that have been manufactured according to the prior art.

The highest coercive field strength was achieved with magnet 322/1 after a tempering at a temperature of 630° C.

The magnet 322/1, which was sintered at a temperature of 1080° C., achieved a coercive field strength of 10.4 kOe, whereby its remanence amounts to 1.41 T. An alignment degree of the grains of 96% was measured in this magnet, and the relative density amounts to 98%. Computationally, a remanence of 1.415 T is thereby to be expected, i.e. a very good coincidence with the measured value.

The present invention presents a new boron-free and iron-free binder alloy with the composition $SE_5(Co, Ga)_3$ or manufacturing permanent magnets. The melting temperature of this binder alloy lies at approximately 530° C.

The employment of these binder alloy mixtures for the powder-metallurgical manufacture of permanent magnets exhibits considerable advantages over the individual binder alloys.

The proportion of binder alloy can thus be decidedly reduced compared to the proportion of binder alloys according to the prior art, i.e. to a proportion below 7 weight %.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for manufacturing a permanent magnet, comprising the steps of:

$a_1$) mixing a powder of a magnetic base alloy of a general formula $$SE_2T_{14}B,$$

wherein SE is at least one rare earth element, including Y, and T is selected from the group consisting of Fe and a combination of Fe and Co, whereby the Co part does not exceed 40 weight % of the combination of Fe and Co, $a_2$) and powders of at least two binder alloys of respective general formulas $$SE_6(Fe, Co)_{13-x}Ga_{1+x}$$

and $$SE_2Co_3$$

wherein $0 \leqq x \leqq 2$, in a weight ratio to obtain a mixture between 99:1 to 89:11;

b) comprising the mixture to obtain a compressed mixture and;

c) sintering the compressed mixture in an environment selected from the group consisting of a vacuum and an inert gas atmosphere.

2. A method according to claim 1, wherein the step of mixing comprises mixing said base alloy and said binder alloys in a weight ratio of base alloy to binder alloys between 99:1 and 93:7.

* * * * *